US009852834B2

(12) United States Patent
Thompson et al.

(10) Patent No.: US 9,852,834 B2
(45) Date of Patent: Dec. 26, 2017

(54) ADJUSTABLE CENTER POLE

(71) Applicant: Parker-Hannifin Corporation, Cleveland, OH (US)

(72) Inventors: Jesse Thompson, Shepherdsville, KY (US); Douglas A. Markelonis, Willowick, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 14/587,484

(22) Filed: Dec. 31, 2014

(65) Prior Publication Data

US 2015/0187482 A1 Jul. 2, 2015

Related U.S. Application Data

(60) Provisional application No. 61/922,157, filed on Dec. 31, 2013.

(51) Int. Cl.

| | |
|---|---|
| ***H01F 7/08*** | (2006.01) |
| ***H01F 7/13*** | (2006.01) |
| ***H01F 7/16*** | (2006.01) |

(52) U.S. Cl.

CPC ..... *H01F 7/081* (2013.01); *H01F 7/13* (2013.01); *H01F 7/1607* (2013.01)

(58) Field of Classification Search

CPC ..... H01F 7/081; H01F 7/1607; H01F 7/13
See application file for complete search history.

(56) References Cited

U.S. PATENT DOCUMENTS 1,655,453 A * 1/1928 Brown ..... H01F 7/1607 335/270
2,444,118 A * 6/1948 Snyder ..... H01F 7/1607 310/30
3,742,407 A * 6/1973 Cardew ..... H01F 7/088 335/258
4,651,118 A * 3/1987 Zeuner ..... H01F 7/1607 335/258
5,407,174 A * 4/1995 Kumar ..... H01F 7/1607 251/129.08
5,586,747 A * 12/1996 Bennardo ..... F16K 31/0658 251/129.18

FOREIGN PATENT DOCUMENTS

SU FR 2327616 A1 * 5/1977 ..... H01F 7/13

* cited by examiner

*Primary Examiner* — Mohamad Musleh
(74) *Attorney, Agent, or Firm* — Renner, Otto, Boisselle & Sklar, LLP

(57) ABSTRACT

An adjustable solenoid assembly with an adjustable threaded pole having an interference fit section to be used with a complementary threaded receiver (e.g., the bore of the top plate) with an interference fit section. The adjustable threaded sections are used to pull or push the interference fit sections together and allow for precise locating of the interference fit sections and adjustment. The threaded pole may be used to set and maintain a precision working air gap between the pole piece and the plunger of the electromagnetic solenoid assembly. The interference fit holds the pole piece into location while still allowing the solenoid to be adjustable without a loss in flux density.

15 Claims, 2 Drawing Sheets

ADJUSTABLE CENTER POLE

This application claims the benefit of U.S. Provisional Application No. 61/922,157 filed Dec. 31, 2013, which is hereby incorporated herein by reference.

FIELD OF INVENTION

The present invention relates generally to solenoid actuators, and more particularly to solenoid actuators having an adjustable pole for precisely adjusting a working air gap.

BACKGROUND

A conventional method of setting the air gap between a pole of a solenoid actuator and the plunger is to use a mechanical spacer to control the air gap. The center pole is permanently pushed into position until the mechanical stop is reached. To tune the solenoid to the system the technician must adjust the spring pressure, the amount of current, or the pulse-width modulation (PWM) signal percentage going into the solenoid.

SUMMARY OF INVENTION

Therefore, presented is a solenoid assembly with an adjustable threaded pole having an interference fit section to be used with a complementary threaded receiving (e.g., the bore of the top plate) component with a complimentary interference fit section. The adjustable threaded sections are used to pull or push the interference fit sections together and allow for precise locating of the interference fit sections and adjustment of the working air gap, thereby controlling solenoid operation without having to adjust spring pressure or coil current. Using a fast switching hydraulic pilot valve as a non-exhaustive example, the threaded pole is used to set and maintain a precision working air gap between the pole piece and the plunger of the electromagnetic solenoid assembly. The interference fit holds the pole piece into location while still allowing the solenoid to be adjustable without a loss in flux density.

According to one aspect of the invention, an adjustable solenoid assembly includes a solenoid body; a coil for producing a magnetic field in an area of the assembly in response to electrical energization of the coil; a plunger mounted for longitudinal movement in said area of the assembly, the plunger bounded by an outer surface extending generally adjacent the inner wall of said coil, said plunger longitudinally movable in said assembly responsive to the magnetic field produced by the coil; a receiver including a threaded portion and an interference portion; an adjustable pole receivable in the bore and including a threaded portion and an interference portion, wherein the threaded portion of the adjustable pole is complementary to and threadably engageable with the threaded portion of the receiver, and the interference portion of the adjustable pole is complementary to and interferingly engageable with the interference portion of the receiver.

Optionally, the adjustable solenoid assembly includes an interference relief area.

Optionally, the interference relief area is arranged longitudinally between the threaded portions and the interference portions.

According to another aspect of the invention, a method of adjusting an adjustable solenoid assembly having a coil and an adjustable pole, comprising the steps of: electrically energizing the coil; monitoring an output of the solenoid assembly while the coil is energized; and adjusting the adjustable pole while monitoring the output.

Optionally, the solenoid assembly includes a coil for producing a magnetic field in an area of the assembly in response to electrical energization of the coil; a plunger mounted for longitudinal movement in said area of the assembly, the plunger bounded by an outer surface extending generally adjacent the inner wall of said coil, said plunger comprised of magnetic material and longitudinally movable in said assembly responsive to the magnetic field produced by the coil; a receiver including a threaded portion and an interference portion; an adjustable pole receivable in the receiver and including a threaded portion and an interference portion, wherein the threaded portion of the adjustable pole is complementary to and threadably engageable with the threaded portion of the receiver, and the interference portion of the adjustable pole is complementary to and interferingly engageable with the interference portion of the receiver.

Optionally, the adjustable solenoid assembly includes an interference relief area.

Optionally, the interference relief area is arranged longitudinally between the threaded portions and the interference portions.

Optionally, the monitoring of the output further includes monitoring the output pressure of a fast switching hydraulic pilot valve.

The foregoing and other features of the invention are hereinafter described in greater detail with reference to the accompanying drawings.

DETAILED DESCRIPTION

Electromechanical solenoid actuators include an electromagnetically inductive coil, wound around a movable armature or plunger. The coil is shaped such that the plunger can be moved in and out of the center, altering the coil's inductance and thereby becoming an electromagnet. The actuator may be used to provide a mechanical force to some mechanism such as controlling a hydraulic valve. Solenoid actuators may be controlled directly by a controller circuit, and typically have quick reaction times.

Generically, for a solenoid to operate two air gaps are required: one between the center pole and the plunger, and one between the solenoid body and plunger. These air gaps allow for the plunger to move based on the amount of magnetic force generated by the coil. Any additional air gaps reduce the flux density of the solenoid assembly, decreasing the efficiency of the design. The exemplary adjustable solenoid pole discussed herein does not introduce a third air gap into the system as in conventional adjustable solenoids. Exemplary embodiments utilize a press fit between the solenoid top plate (e.g., part of the solenoid body) and the pole. Threads are used to bring the press fit into position and allow for adjustment once the solenoid is assembled. The threads can move the pole in or out of the coil, increasing or decreasing the air gap between the pole and the plunger. This resulting force, or movement of the plunger, can be monitored to tune the solenoid to the desired value. In the case of a fast switching hydraulic pilot valve the output pressure can be monitored while the pole is being adjusted to achieve the desired output pressure.

Figure 1:
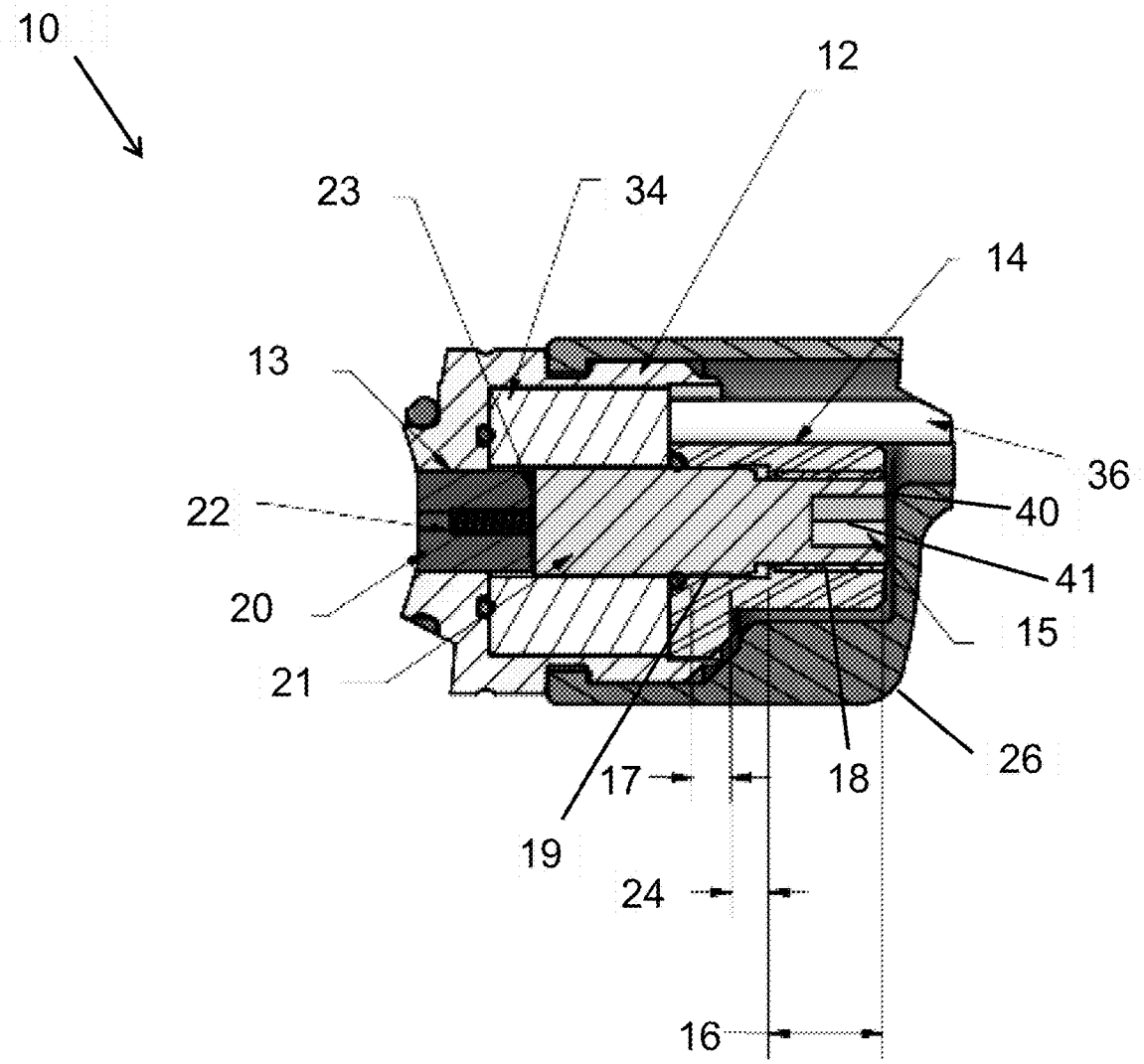
FIG. 1 shows a partial cross-sectional view of an exemplary adjustable solenoid assembly having an adjustable pole with an interference fit section.

An exemplary actuator 10 is shown in FIG. 1 and includes a precisely adjustable pole 21 for controlling the working air gap 23 between the plunger 20 and the pole 21. The solenoid actuator 10 includes a solenoid body 12 housing the plunger 20 which is moveable within the body via energization of a coil 34.

The actuator 10 includes a cap 26 which may include a port for electrical connection of the actuator to a power source and/or controller (not shown). The cap 26 may generally seal the interior components away from the operating environment by sealingly connecting to the body 12, thereby preventing contamination and corrosion of interior components. The coil 34 is supported in the body 12 and is connected to the power source via coil wire leads 36 passing through the cap 26. The coil 34 may be bounded inwardly by a sleeve member (not shown).

The armature or plunger 20 is positioned in the body 12 and may be, for example, generally circular in cross section, although other cross-sectional shapes are possible. The plunger has an outer surface spaced from the body 12 and defining therewith a non-working air gap 13 between the plunger and the body. The plunger 20 is longitudinally moveable inside the body 12, and the lower end of plunger 20 (not shown) may be in abutting or other contact with the element to be actuated. The plunger 20 may be permanently or temporarily secured, directly or indirectly, with the element to be actuated as is known in the art.

A solenoid top plate 14 may be provided as a portion of the body 12 or as a separate component (for example, for ease of coil assembly). A receiver (e.g., bore) 15 through the top plate accepts an adjustable pole 21. In particular, pole 21 may be threadably received in the bore 15 by a threaded section 16 of the top plate, and may be press fit into the bore in a press fit or interference section 17 of the bore.

In operation of the actuator, electric current is supplied through the coil 34 to create an electromagnetic field. The magnetic force causes plunger 20 to move from a first position spaced apart from the pole 21 to a second position towards the pole 21 in proportion to the force of the field. The force of the plunger overcomes the opposing force of the spring 22 and thereby moves the element to be actuated. Reducing the current through coil 34 reduces the magnetic force on plunger 20 and enables spring 22 to move the plunger toward the first position.

In exemplary embodiments, the solenoid may be used to control the flow of a hydraulic fluid through a valve. Of course in other embodiments of the invention, the flow of other types of fluid (e.g., refrigerant material) may be controlled or other types of control elements may be used other than valve elements. Exemplary embodiments are suited for use with proportional valves and two position valves, as well as valves that are normally open or normally closed.

The adjustable threaded pole 21 is also provided with an interference section 19 to engage the complementary interference section 17 of a threaded receiving (e.g., the bore 15 of the top plate 26) component.

Likewise, the adjustable threaded pole 21 is provided with a threaded section 18 to engage the complementary threaded section 16 of the threaded receiving component (e.g., bore 15 of the top plate 26). The adjustable threaded sections are used to pull or push the interference fit sections together and allow for precise locating of the interference sections and adjustment. Using a fast switching hydraulic pilot valve as an example, the threaded pole is used to set and maintain a precision working air gap between the pole piece and the plunger of the electromagnetic solenoid assembly. The interference fit holds the pole piece into location while still allowing the solenoid to be adjustable without a loss in flux density.

By threaded sections 16 and 18, it is meant that these sections each include a screw thread that, when intermeshed or engaged are used to convert rotational movement/force on the pole relative to the rest of the assembly into linear longitudinal movement/force on the pole relative to the rest of the assembly.

The lead of the screw threads may be chosen so that friction is sufficient to prevent the screw from slipping when linear force is applied in the absence of rotational force. Further, because fine adjustment is preferred in exemplary embodiments, the lead may be chosen to be a particularly fine lead to provide adjustment fidelity to approximately one ten-thousandths of an inch. In particular, the bore 15, the threaded sections 16 and 18, the pole 21 and the body 12 are configured to provide such fidelity and to allow for a final working air gap of about 9-10 thousandths of an inch.

By interference sections 17 and 19, it is meant that the interference section 17 includes a diameter corresponding to the diameter of a corresponding interference section 19 of the adjustable pole 21 for providing an interference fit therebetween. The interference sections, therefore, at least partially overlap in a longitudinal direction (i.e., along the stroke direction of the plunger). The interference fit may be a press fit in which the outer diameter of the pole is larger than the inner diameter of the bore.

The pole 21 may include an exterior end face 40 including a tool engagement portion 41 for allowing a tool to be used to rotate the pole 21 with respect to the rest of the solenoid assembly 10 and thereby longitudinally adjust the pole 21. The tool engagement portion 41 may be any appropriate form such as a hexagonal bolt end for interfacing with a socket, a socket for engaging with a hex-key tool, or a slot or cross for engaging with a screw driver. Alternatively, a proprietary or specialized form may be used to prevent unauthorized tampering.

Optionally, a relief section 24 of the bore 15 may be included in which the inner diameter is greater than the outer diameter of a corresponding relief section 25 of the pole 15. These relief sections at least partially overlap in the longitudinal direction and allow for control of the size of the overlapped portion of the longitudinally overlapping interference sections.

In an embodiment, the interference sections 17 and 19 are longitudinally spaced from the end of the adjustable pole 21 proximate the plunger 20. In an embodiment, the interference sections 17 and 19 are longitudinally spaced from the end of the adjustable pole 21 distal the plunger 20. In an embodiment, the interference sections 17 and 19 are longitudinally proximal to but not overlapping the coil 34.

In an embodiment, the threaded sections 16 and 18 are longitudinally spaced from the interference sections 17 and 19. In an embodiment, the threaded sections 16 and 18 are adjacent the end of the adjustable pole distal the plunger 20.

In an embodiment, the relief sections 24 and 25 may be longitudinally intermediate between the interference sections 17 and 19 and the threaded sections 16 and 18.

Lubricating coatings can also be applied to the adjustable pole 21 or the solenoid top plate 14 to ease in the assembly of the interference fit. Coatings such as oil, grease, or wax can reduce the torque required to turn the center pole 21 into position and prevent galling.

A difference between exemplary embodiments and conventional solenoids is the ability of exemplary embodiments to precisely set and/or adjust the air gap, or magnetic force, for a constant input current. This provides the device the ability to be tuned to a specified air gap, or magnetic force, for a specific current input. This has the benefit of being able to consistently produce a set threshold or maximum output for the solenoid device. By being able to accurately tune the solenoid, replacement parts could be introduced into the system with little or no control system adjustment. Adjustments could also be made in the field to further tune the solenoid without requiring special tools or test equipment. The field technician could adjust the coil center pole, increasing or decreasing the air gap, or magnetic force, until the desired setting is reached. Using the fast switching hydraulic pilot valve as an example, the technician could monitor the pressure controlled by the valve solenoid and increase it or decrease it as required in the system.

Exemplary embodiments also have the benefit of allowing adjustment with a minimal amount (or no) axial force being applied to the solenoid assembly. This is advantageous because it prevents adjustments of the air gap that are made in the field from resulting in valve misalignment when the solenoid assembly is being used to actuate a valve.

Exemplary embodiments also have the added benefit of being adjustable while not introducing a third air gap for the adjustment. This prevents a loss in flux density resulting in a stronger magnetic force for the amount of current supplied to the solenoid.

Figure 2:
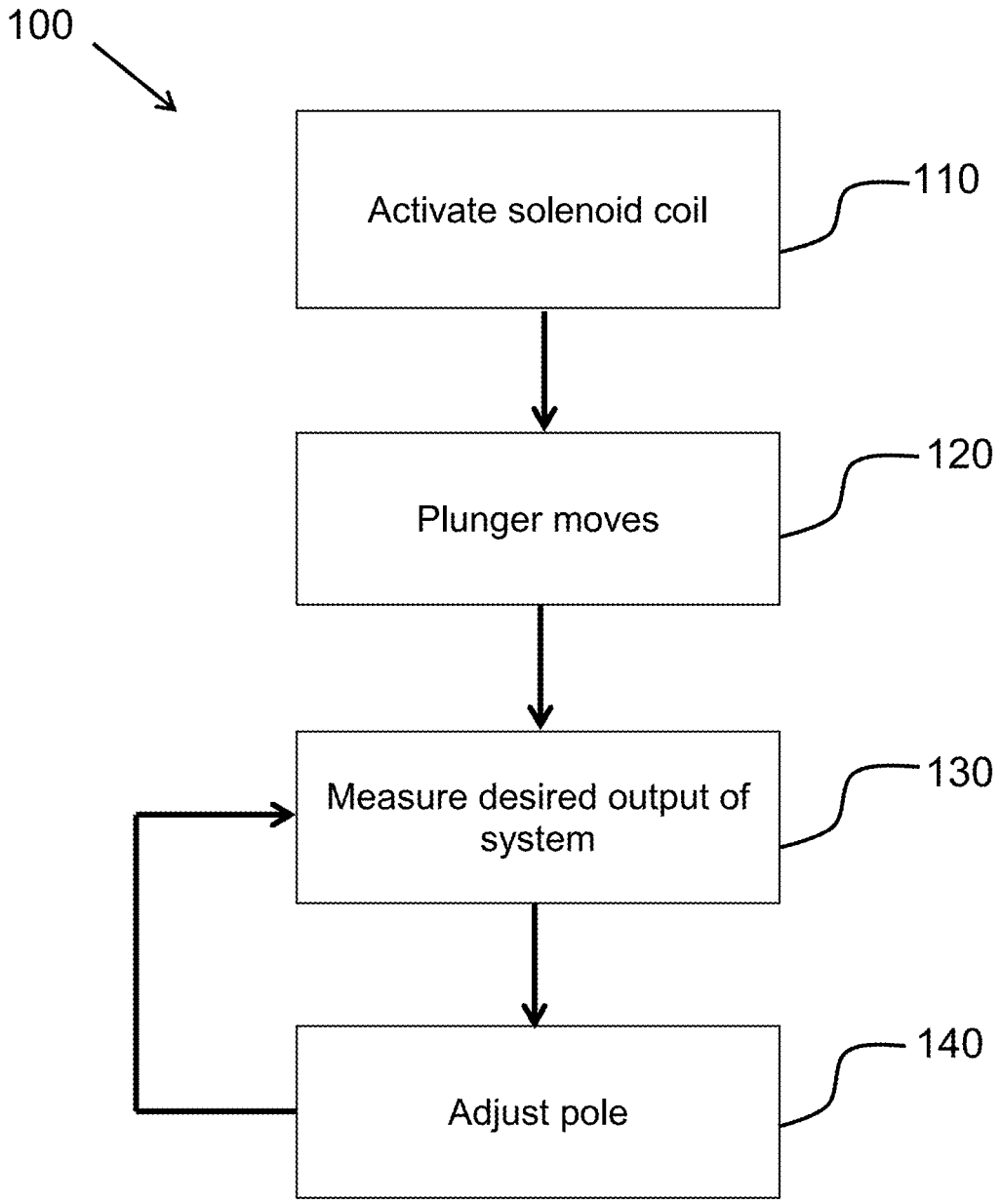
FIG. 2 shows a method of adjusting an adjustable pole in exemplary solenoid assemblies.

Turning to FIG. 2, shown is a method 100 for adjusting an air gap between an adjustable pole and a plunger of an adjustable solenoid controlling a valve. Although it is understood that this method may be applied to other situations, the example given herein of controlling a valve is used for clarity and expediency.

At block 110, the solenoid coil is activated, for example, by applying a current to the coil. This current may be supplied by a controller integrated into the system of which the solenoid is a part, or may be a stand-alone power supply. Use of an integrated power supply (e.g., using the system controller) that is part of the system the solenoid is a part of may more accurately predict actual system performance. The current supplied may be any appropriate current for the solenoid, for example 200 mA.

At block 120, the plunger of the solenoid moves in response to the activated coil.

At block 130, a measurement of the output of the system controlled by the solenoid is obtained. Direct measurement of the displacement of the solenoid plunger may be measured. Alternatively, measurement of the mechanism moved by the plunger may be measured to better reflect actual system performance. Alternatively, measurement of another variable that provides the critical output of the device or system the solenoid is being used on may provide the most accurate reflection of future system performance. For example, at block 130, measurement of pressure at a control port of a valve may be obtained.

At block 140, adjustment of the adjustable pole is performed. In particular, the adjustable pole is rotated in the appropriate direction to move the pole in the longitudinal direction and thereby increase or decrease the working air gap between the pole and the plunger.

Blocks 130 and 140 may be continuously and/or iteratively performed until the desired result (e.g., pressure) is obtained.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An adjustable solenoid assembly comprising:

a solenoid body;

a coil for producing a magnetic field in an area of the assembly in response to electrical energization of the coil;

a plunger mounted for longitudinal movement in said area of the assembly, the plunger bounded by an outer surface extending generally adjacent the inner wall of said coil, said plunger longitudinally movable in said assembly responsive to the magnetic field produced by the coil;

a receiver including a threaded portion and an interference portion;

an adjustable pole receivable in the receiver and including a threaded portion and an interference portion, wherein the threaded portion of the adjustable pole is complementary to and threadably engageable with the threaded portion of the receiver, and the interference portion of the adjustable pole is complementary to and interferingly engageable with the interference portion of the receiver to provide a press fit between the receiver and adjustable pole, and wherein the threaded portion of the reciever is longitudinally offset from the interference portion of the receiver.

2. The adjustable solenoid assembly of claim 1, further comprising an interference relief area.

3. The adjustable solenoid assembly of claim 2, wherein the interference relief area is arranged longitudinally between the threaded portions and the interference portions.

4. The adjustable solenoid assembly of claim 1, wherein the plunger comprises magnetic material.

5. The adjustable solenoid assembly of claim 1, wherein the threaded portion of the pole is longitudinally offset from the interference portion of the pole.

6. The adjustable solenoid assembly of claim 1, wherein an interfering area between the interference portion of the pole and the interference portion of the receiver is a minimum area so as to not saturate flux density therethrough.

7. The adjustable solenoid assembly of claim 1, wherein the receiver is a bore in a top plate.

8. The adjustable solenoid assembly of claim 7, wherein the top plate is a portion of the body.

9. A method of adjusting an adjustable solenoid assembly having a coil and an adjustable pole, the method comprising the steps of:

electrically energizing the coil;

monitoring an output of the solenoid assembly while the coil is energized; and adjusting the adjustable pole while monitoring the output; and wherein the adjusting step includes adjusting the adjustable pole against a holding force provided by a press fit between the adjustable pole and a reciever in which the adjustable pole is threaded to effect adjustment by rotating the pole piece relative to the reciever.

10. The method of claim 9, wherein the solenoid assembly is the solenoid assembly of claim 1.

11. The method of claim 9, wherein the monitoring the output further includes monitoring the output pressure at a control port of an associated valve.

12. The method of claim 11, wherein the associated valve is a fast switching hydraulic pilot valve.

13. The method of claim 9, wherein electrically energizing the coil includes applying a current of approximately 200 milliamps.

14. The method of claim 9, wherein the adjusting step includes longitudinally moving the adjustable pole by rotating the pole with respect to a receiver receiving the pole.

15. The method of claim 9, wherein the adjusting step includes adjusting the adjustable pole in a longitudinal direction with precision of about one ten-thousandths of an inch.

* * * * *